US005567899A

United States Patent [19]

Hoshino

[11] Patent Number: 5,567,899

[45] Date of Patent: Oct. 22, 1996

[54] BEATER ROTARY SHAFT ARRANGEMENT FOR DUAL DRUM PEDAL

[75] Inventor: Yoshiki Hoshino, Aichi-ken, Japan

[73] Assignee: Hoshino Gakki Co., Ltd., Japan

[21] Appl. No.: 430,494

[22] Filed: Apr. 28, 1995

[30] Foreign Application Priority Data

Jan. 18, 1995 [JP] Japan ..... 7-000567 U

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS 3,195,391 7/1965 Peters ..... 84/422.1

4,188,853 2/1980 Bills ..... 84/422.1

5,204,485 4/1993 Lombardi ..... 84/422.1

*Primary Examiner*—Cassandra C. Spyrou

*Attorney, Agent, or Firm*—Ostrolenk, Faber, Gerb & Soffen, LLP

[57] ABSTRACT

A beater assembly includes a first beater rotary shaft which is linked with a first operating shaft through a first link, and a second beater rotary shaft which is linked to a second operating shaft through a second link. The first and second beater rotary shafts are linked through a bearing which permits relative rotation between the first and second beater rotary shafts and those shafts are supported at the tops of supports on both sides of the beater assembly. A respective cam member is rotatably adjustably installed at one end of the first rotary shaft and the second rotary shaft and a spring is provided between each of the cam members and the lower part of the supports.

11 Claims, 8 Drawing Sheets

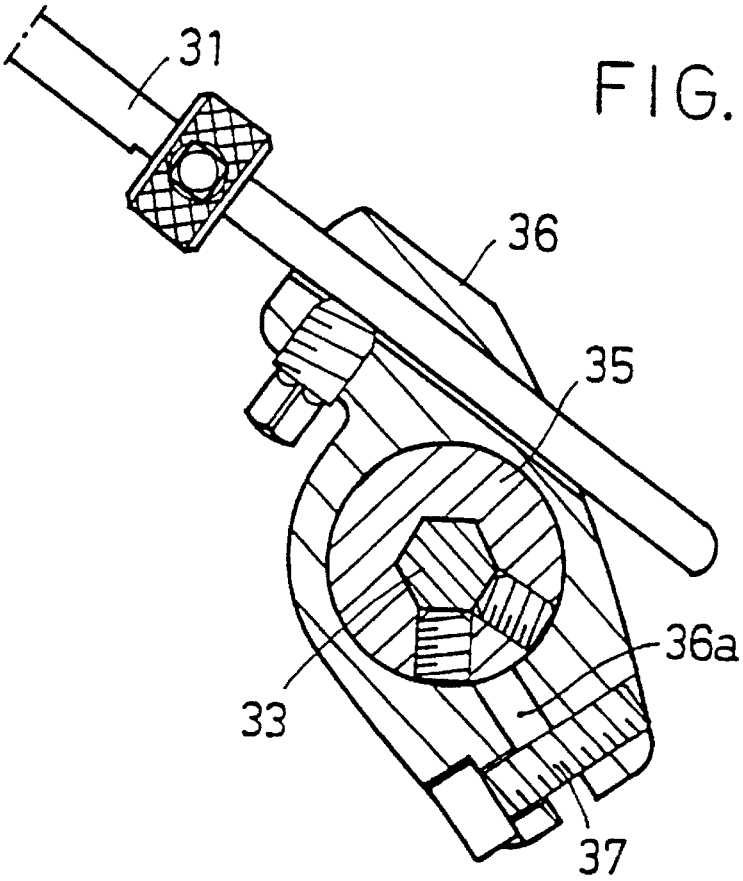
FIG. 6
FIG. 7
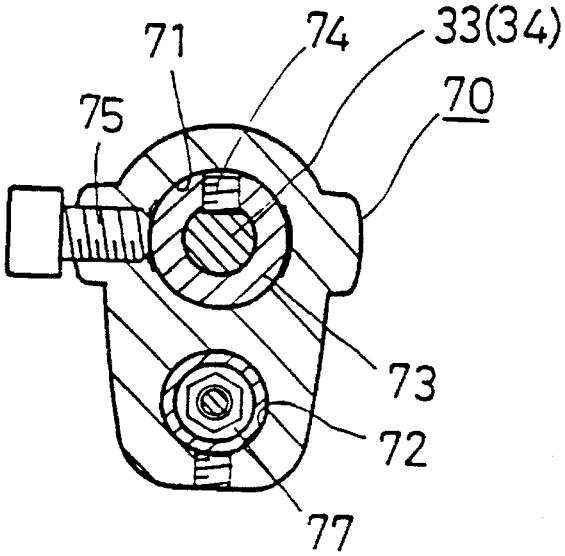

BEATER ROTARY SHAFT ARRANGEMENT FOR DUAL DRUM PEDAL

BACKGROUND OF THE INVENTION

The present invention relates to dual drum pedals, and more particularly to dual drum pedals with which the performer can perform while directly facing the audience, and an adjustment of the height position of the drum pedals can be readily carried out.

In conventional dual drum pedals, an independent drum pedal is installed on each of the two pedal assemblies, and two beaters are provided one on each of the pedal assemblies. The pedal assembly on which the beater has been installed is set against the bass drum. Typically, the drum head of the bass drum is arranged in such a manner as to face the audience. This positions the performer to obliquely face the audience. When the beater is installed on the pedal assembly on the right side, for example, the performer will face obliquely to the left.

In contrast, it is desirable for the performer to directly face the front of the stage in order to observe the audience and the stage and to more effectively appeal to the audience.

In addition, it is desirable for the height position of the drum pedal and the amplitude of the beater to be freely adjustable according to the movement of the performer's feet and in conformity with the desire of the performer and his style of performance.

SUMMARY OF THE INVENTION

An object of the present invention is to overcome the above problems of a conventional dual drum pedal and to provide a dual drum pedal with which a performer can perform directly facing the audience and, at the same time, adjustments of the height position of the drum pedal and the amplitude of the beater can be carried out freely.

Another object of the present invention is for the drum pedal to be arranged at a suitable angle so that the performer can perform while directly facing the audience, and the performer is able to observe the audience and stage accurately, thereby making it possible for the performer to more effectively appeal to the audience.

Yet another object of the present invention is to install the beater rotary shaft freely rotatably, with a consequence that it becomes possible to adjust the amplitude distance of the beater without needless steps.

Still a further object is that, as the beater is installed freely rotatably as compared with the beater rotary shaft, the amplitude distance of the beater can be adjusted without needless steps, and with the height of the pedal left unadjusted.

Another object is that the amplitude distance of the beater and the height of the pedal can be adjusted independently of each other. This makes it possible to make fine adjustments, accurately adapting to the desire of the performer and conforming to the style of the performance.

According to the present invention, the dual drum pedal includes a first pedal and a first operating shaft that is rotated by the first pedal, a second pedal and a second operating shaft that is rotated by the second pedal. A beater assembly is arranged approximately midway between the first and second pedal and includes a first beater that is operated by the first operating shaft and a second beater that is operated by the second operating shaft.

The first beater is connected to and rotatably adjusted to a first beater rotary shaft. The first beater rotary shaft is linked to the first operating shaft through a first link. The second beater is connected to and rotatably adjusted to a second beater rotary shaft. The second beater rotary shaft is linked to the second operating shaft through a second link. The first and second beater rotary shafts are linked by a bearing.

Other features and advantages of the present invention will become apparent from the following description of the invention which refers to the accompanying drawings.

BRIEF DESCRIPTION OF THE DRAWINGS

FIG. 6 is a cross-sectional view of part of the beater part.

FIG. 7 is a cross-sectional view of part of the cam member.

DETAILED DESCRIPTION OF THE INVENTION

Figure 1:
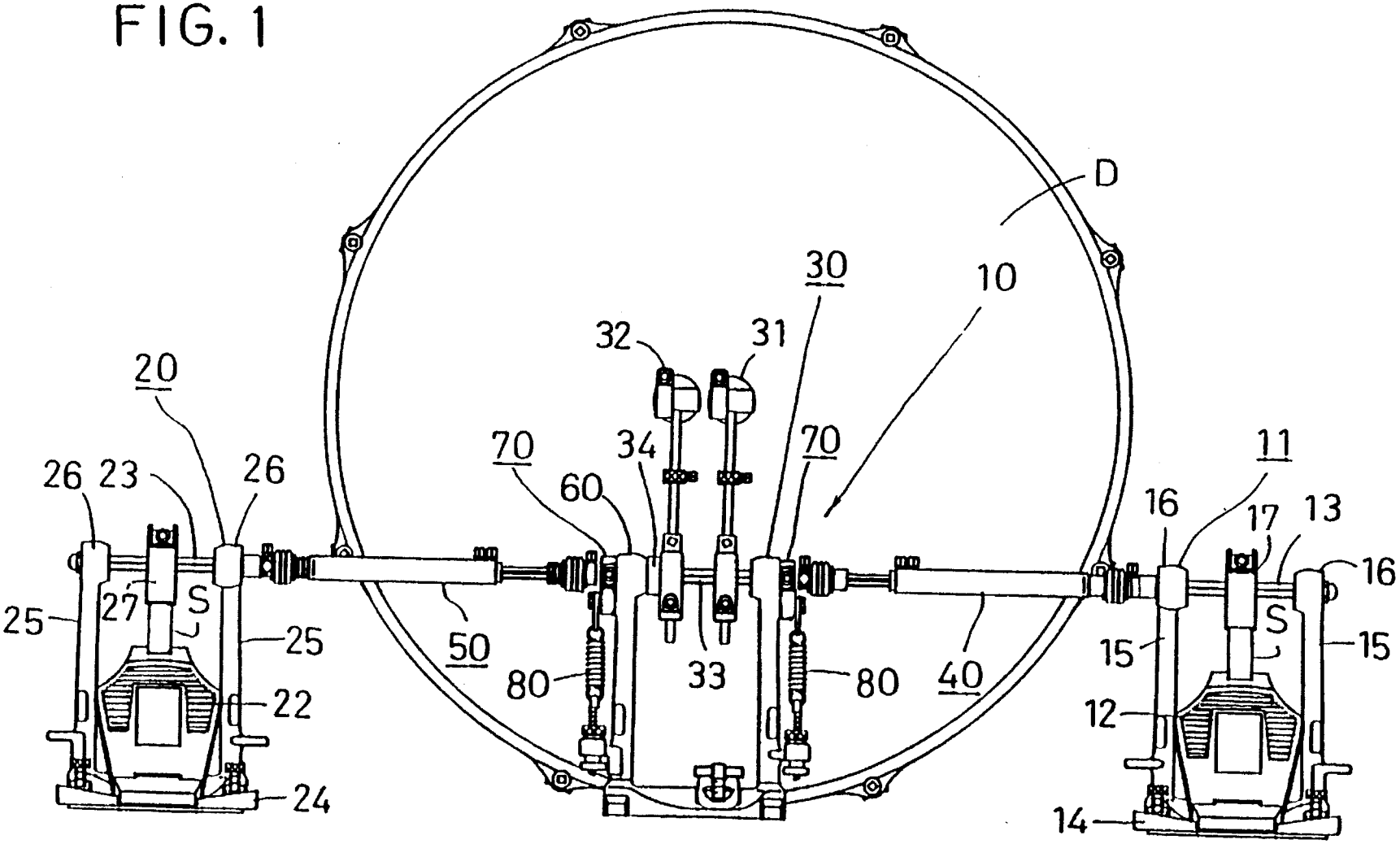
FIG. 1 is a front view of dual drum pedals according to the present invention.
Figure 2:
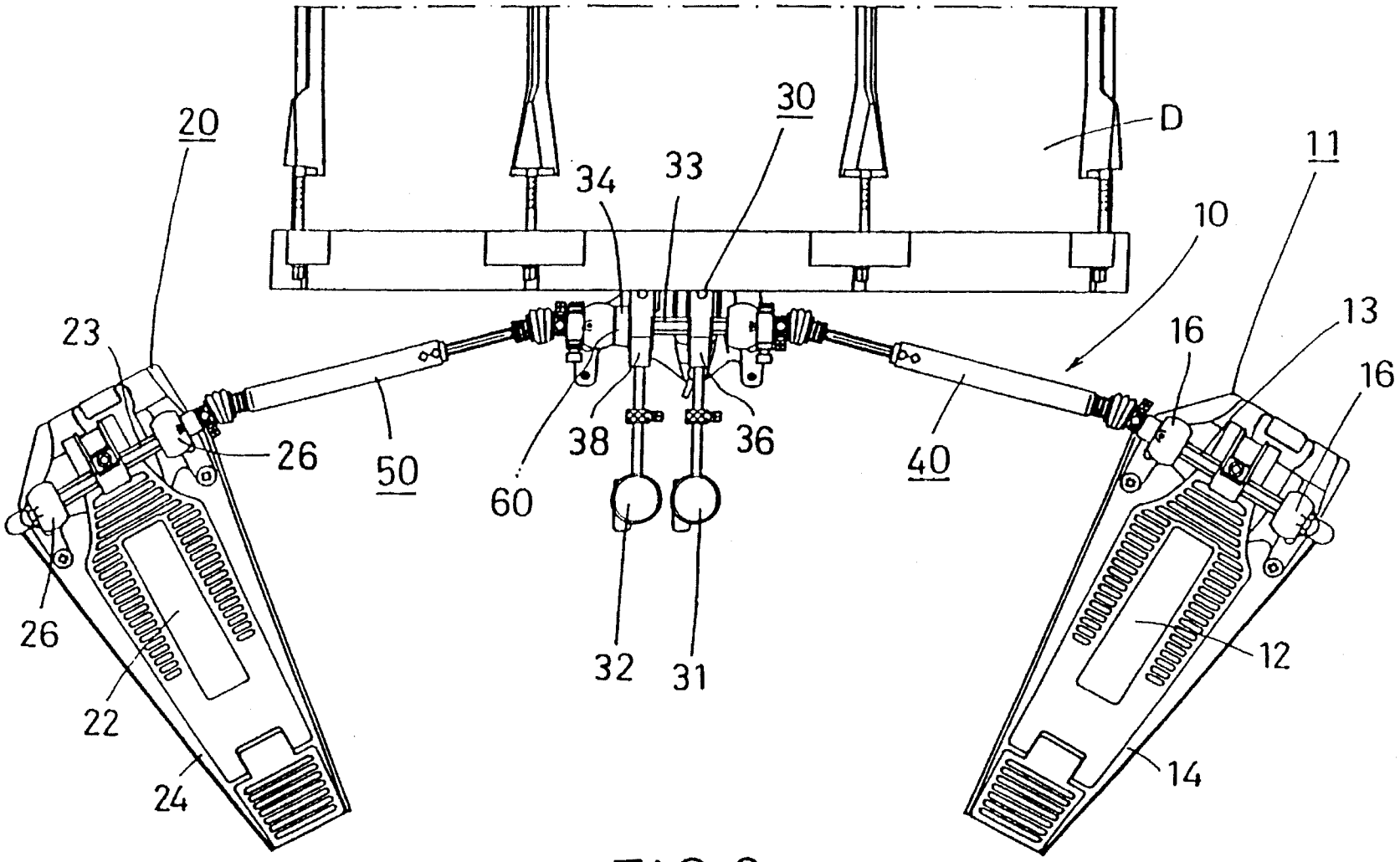
FIG. 2 is a plan view of the dual drum pedals of FIG. 1.

Referring to FIGS. 1 and 2, the dual drum pedal 10 of the present invention includes a first pedal assembly 11, a second pedal assembly 20 and a beater assembly 30. As can be seen in FIG. 2, the first pedal assembly 11 and the second pedal assembly 20 are arranged at a proper angle from a bass drum D which faces the audience. As a result, the performer can perform with his body positioned toward the front of the stage.

Figure 3:
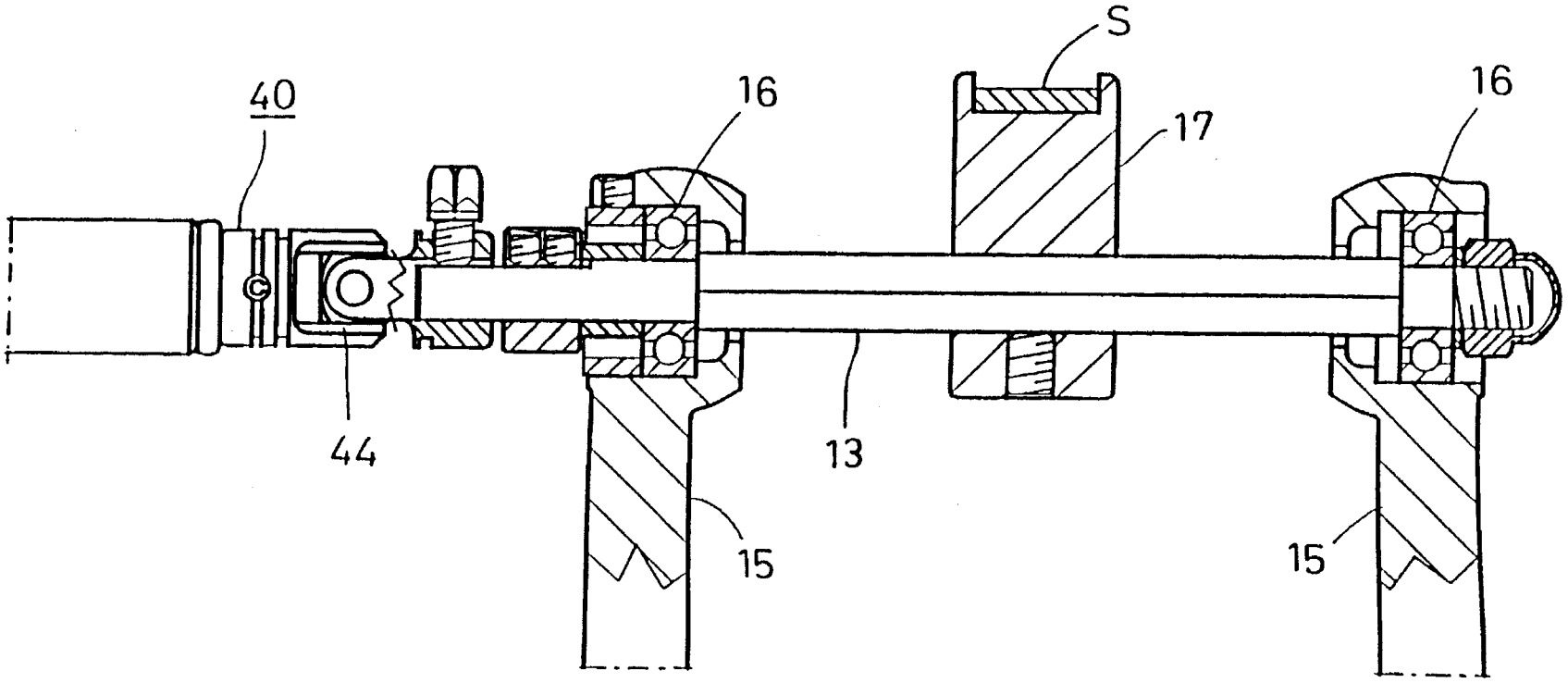
FIG. 3 is a cross-sectional view of part of the dual drum pedals of FIGS. 1 and 2.

The first pedal assembly 11 has a first operating shaft 13 which is rotated by a first pedal 12, and is linked to the beater assembly 30 through a first link 40. In FIGS. 1, 2 and 3, the first pedal assembly 11 includes supports 15 which are provided on both sides of a base 14. The first operating shaft 13 is journaled freely rotatably through a ball bearing 16 provided at the top of each support 15.

Approximately at the center of the first operating shaft 13, there is an installation member 17 which rotates integrally with the first operating shaft 13. The outer periphery of the installation member 17 is wound with a strap S having an end that is fixed to the installation member 17. The other end of the strap S is linked to the tip of the first pedal 12. As the performer steps on the first pedal 12, the strap S is pulled down which rotates the installation member 17 and that rotates the first operating shaft 13.

The first link 40 is installed at one side of the beater assembly 30 and is linked to the first beater rotary shaft 33 of the beater assembly 30, and it links the first operating shaft 13 to the first beater rotary shaft 33.

Figure 4:
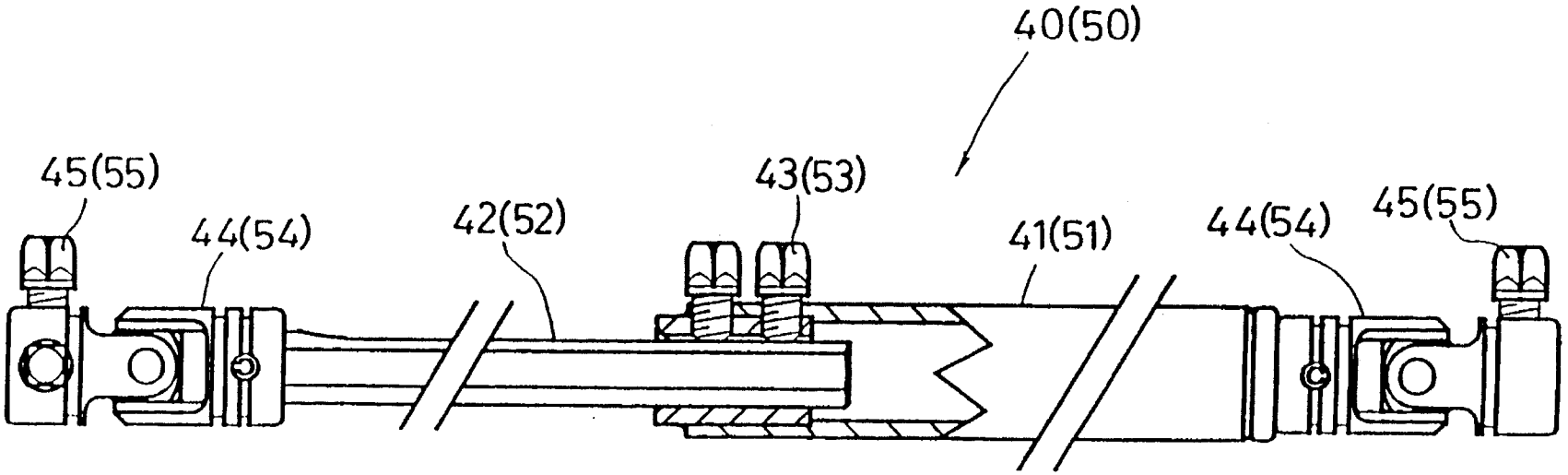
FIG. 4 is a cross-sectional view along the first linking member of the dual drum pedals.

As is shown in FIG. 4, the first link 40 comprises a pipe 41 and a rod 42 having an end that is freely inserted into the pipe 41. The first link 40 has its total length adjusted by the rod 42 that is inserted into the pipe 41. Once the length is adjusted the length is fixed by means of a fixed screw 43.

A universal connector 44 is installed on the other end of the pipe 41 and on the other end of the rod 42, and through this universal connection it is possible for the first pedal assembly 11 to be linked at a selected angle with the beater assembly 30. There is a mounting screw 45 at the free end of each of the universal connectors 44.

The construction of the second pedal 20 assembly is the same as for the first pedal 11. The second pedal assembly 20 includes a second pedal 22, and a second operating shaft 23, which is linked to the beater assembly 30 through a second link 50.

The second pedal assembly 20 includes a base 24, supports 25, bearings 26 at each support 25 for the second operating shaft 23, and an installation member 27 for a strap S. The structure of the second link 50 is the same as that of the first linking 40. Numerical designations for elements of second link 50 are in parentheses in FIG. 4.

The beater assembly 30 includes a first beater 31 and a second beater 32. The beater assembly 30 is arranged approximately midway between the first pedal assembly 11 and the second pedal assembly 20.

The first beater 31 is rotatably adjustably connected to the first beater rotary shaft 33, while the second beater 32 is rotatably adjustably connected to the second beater rotary shaft 34.

Figure 5:
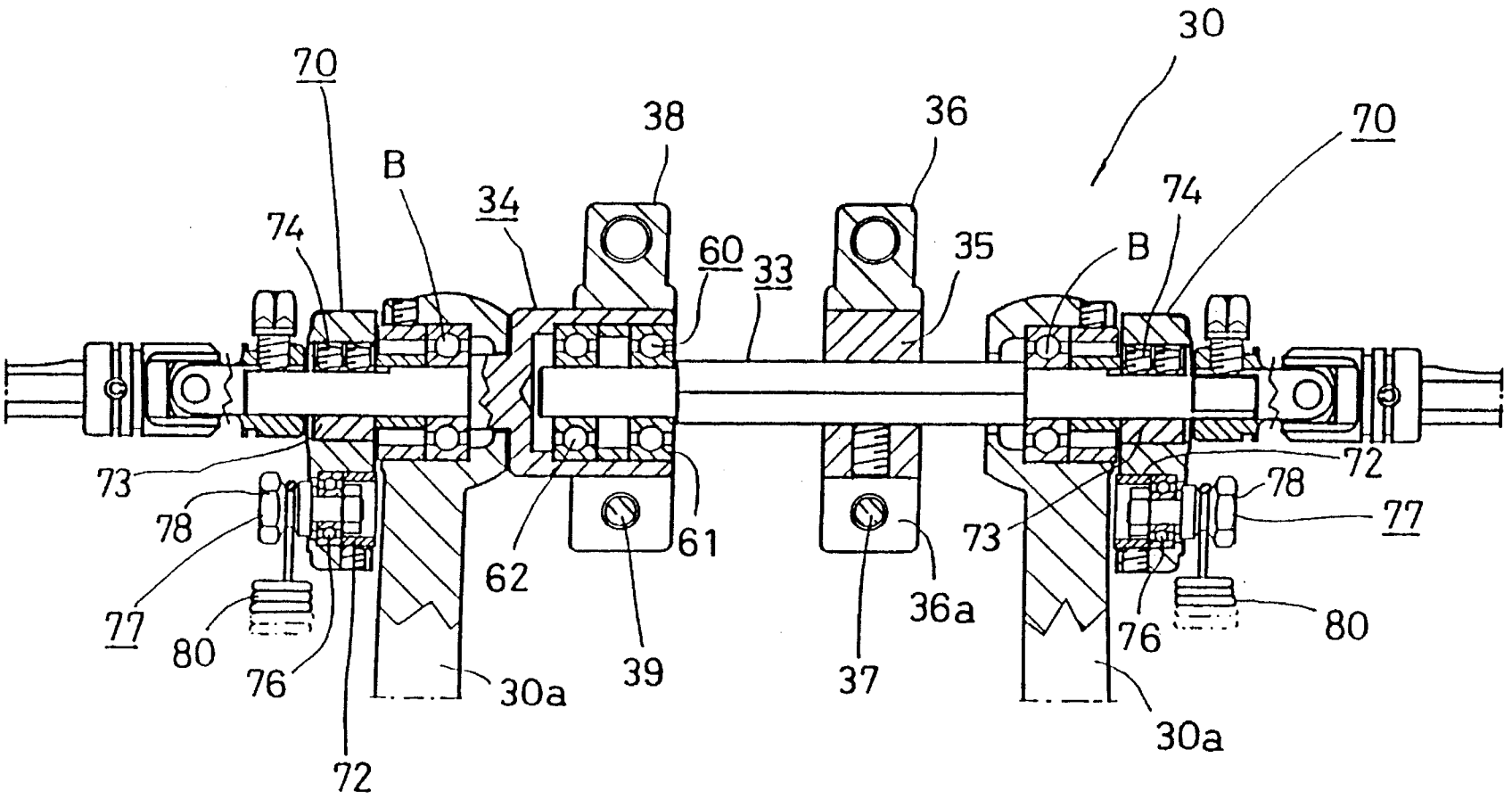
FIG. 5 is a cross-sectional view along the first beater rotary shaft.

As shown in FIGS. 5 and 6, the first beater 31 is fixed to a beater installation member 36 that is installed rotatably and adjustably on a tightening part 35 by installing the tightening part 35 on the first beater rotary shaft 33. This beater installation member 36 is freely rotatably installed on the tightening part 35 and is fixed as it is adjusted to achieve a desired amplitude angle against the drum head of the bass drum D and as the split groove 36*a* is drawn closed by a clamping bolt 37.

As is shown in FIG. 6, the first beater 31 is rotatably adjusted before it is fixed to the first beater rotary shaft 33, and the amplitude distance of the first beater 31 off the drum head surface can be adjusted irrespective of its rotational position around the first beater rotary shaft 33.

Using a similar adjustment procedure, the second beater 32 is adjusted in its rotary position and then is fixed relative to the second beater rotary shaft by a clamping bolt 39 on the beater installation member 38 after it has been rotatably adjustably installed on the second beater rotary shaft 34.

The first beater rotary shaft 33 is linked to the first operating shaft 13 through the first link 40, and the second beater rotary shaft 34 is linked to the second operating shaft 23 of the second pedal assembly 20 through the second link 50. The first beater rotary shaft 33 and the second beater rotary shaft 34 are journaled freely rotatably by means of respective bearings B at the tops of the supports 30*a* and 30*a* that have been disposed on both sides of the beater 30 and, at the same time, are linked integrally through a bearing part 60 comprised of bearings 61 and 62.

As is shown in FIG. 5, the bearing part 60 is provided integrally within one end of the second beater rotary shaft 34, making it possible for the second beater rotary shaft 34 to rotate independently of the first beater rotary shaft 33. Since the first pedal 12 and second pedal 22 can thereby independently activate the first beater 31 and the second beater 32, the desired performance can be carried out by the performer using either the left or the right foot.

A cam 70 is positioned at the outer ends where the first beater rotary shaft 33 and the second beater rotary shaft 34 are not linked. As shown in FIG. 7, the cam 70 has a cam receiver hole 71 through which the first beater rotary shaft 33 or the second beater rotary shaft 34 are inserted.

A fixing screw 74 fixes the cam receiver 73 to each beater rotary shaft. A stopper screw 75 fixes the position of the cam 70 as compared with each beater rotary shaft.

As shown in FIG. 5, a bearing 76 is provided in the roller installation hole 72 of the cam 70, and a roller 77 can be freely and rotatably inserted into the hole 72. A hanger part 78 is provided at the tip of this roller 77, on which one end of the springs 80 is installed.

The bearing 76 enables the roller 77 to be easily rotated without being obstructed by the addition, if any, of the tension of the spring 80 to the hanging part 78.

Figure 8:
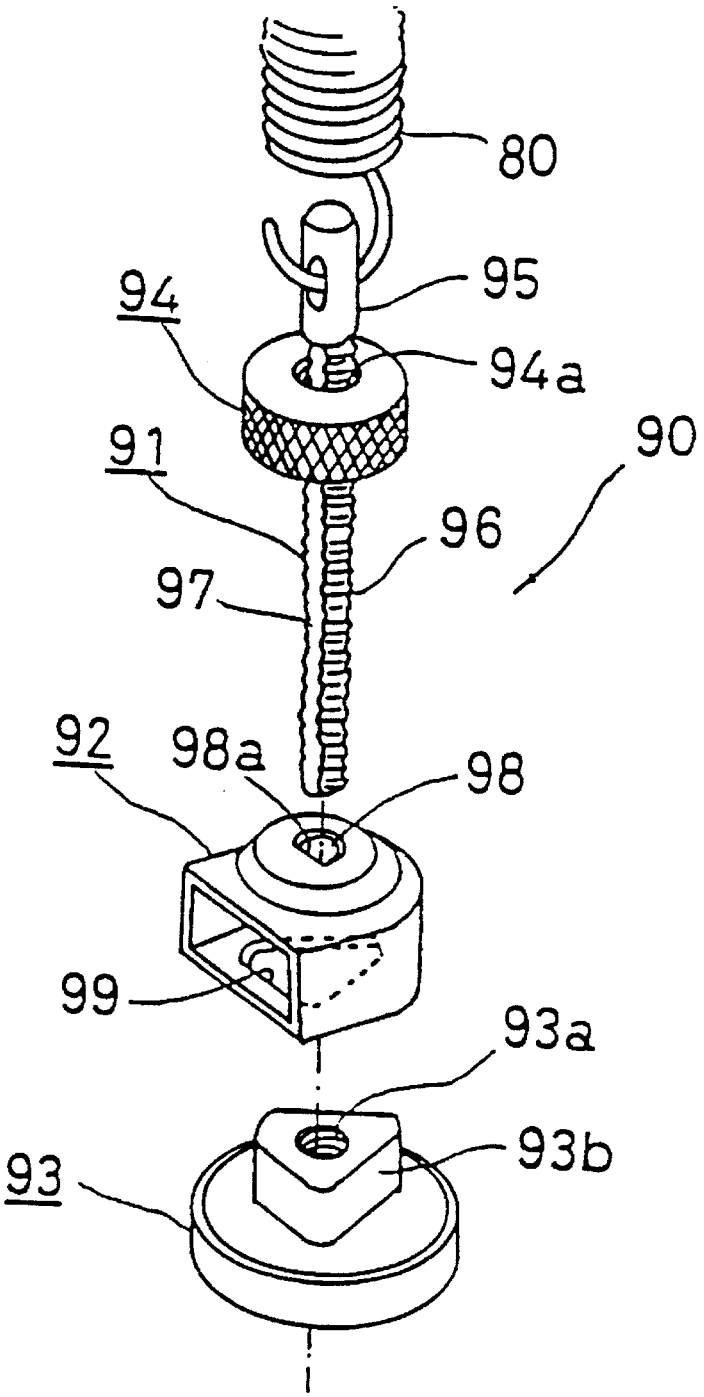
FIG. 8 is an oblique view of the adjusting device, shown dismantled.
Figure 9:
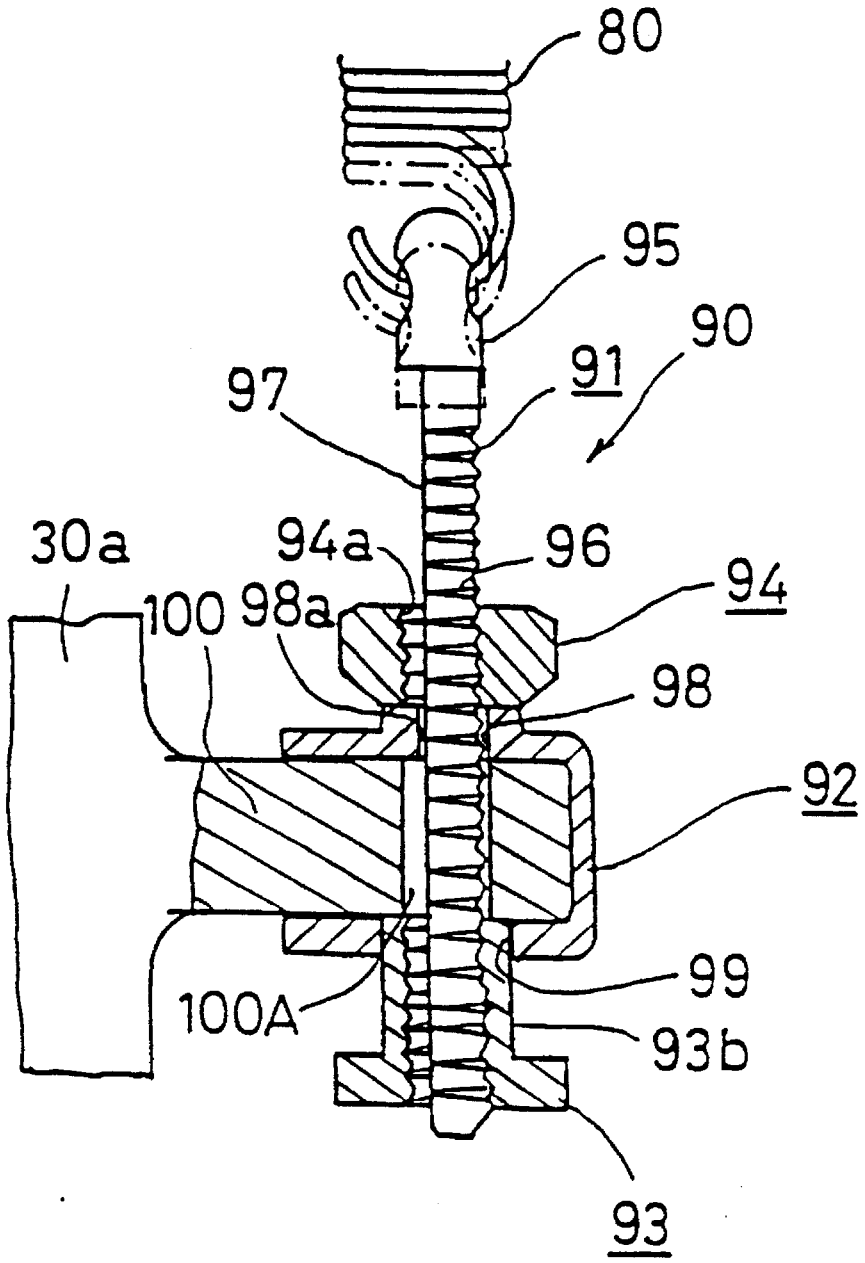
FIG. 9 is a cross-sectional view of the adjustment of the adjusting device.

As is shown in FIGS. 8 and 9, the end of the spring 80, opposite the end that has been installed on the hanging part 78 of the roller 77, is linked to a bracket 100 provided on the lower part of the support 30*a* through an adjusting member 90. The tension of the spring 80 is adjusted with the adjusting member 90 for determining the feel of the first pedal 12 and the second pedal 22 when stepped on, and for determining the return speed of the first beater 31 and the second beater 32.

The adjusting device 90 comprises an adjusting screw 91, a rotation prevention member 92, an adjusting nut 93 and a lock nut 94. The adjusting screw 91 is a bar shaped screw of a suitable length, with spirals 96 provided on its surface. One end of the screw has an engagement part 95 which engages the spring 80. An adjusting nut 93 is screwed onto rotation prevention member 92, opposite the lock nut 94.

Along its longitudinal direction, the adjusting screw 91 has a planar part 97 where the spirals 96 are not formed.

The rotation prevention member 92 prevents any change in the direction of the spring 80 when installed on engagement part 95 as the adjusting screw 91 rotates during adjustment, thereby producing a variation in the resistance or load of the spring 80.

The rotation prevention member 92 has an insertion hole 98 formed in it for receiving adjusting screw 91. An opening 99 is formed at the bottom of member 92 to receive the protrusion 93*b*. The member 92 is installed on bracket 100.

The insertion hole 98 includes an engagement part 98*a* which engages the plane 97 of the adjusting screw 91 which prevents the adjusting screw 91, that has passed into the insertion hole 98, from rotating.

An adjusting nut 93 is screwed on from the bottom of adjusting screw 91. Around a threaded hole 93*a* into of the adjusting nut 93, there is a protrusion 93*b* which engages the cut window 99 of the rotation prevention member 92. As the protrusion 93*b* is engaged with the cut window 99, possible loosening of the adjusting nut 93 is prevented and possible variation in the tension of the spring 80 is prevented.

A lock nut 94 is provided on the adjusting screw 91 at the top of the rotation prevention member 92. The lock nut 94 maintains the screwed length as compared with the rotation prevention member 92 of the adjusting screw 91 as it is screwed to the rotation prevention member 92, and it has a screw hole 94*a* through which the adjusting screw 91 is inserted.

This adjusting device 90 loosens the lock nut 94 and raises it in the direction of the spring 80 and, at the same time, pulls down the adjusting nut 93 along with the adjusting screw 91, thereby removing the protuberant part 93*b* from the cut window 99 of the rotation prevention member 92. This makes the adjusting nut 93 freely rotatable. Then the adjusting nut 93 is rotated and the length of the adjusting screw 91 that is formed between the lower end of the spring and the lower bracket 100 is changed. This adjustment is carried out until a suitable spring tension is obtained.

After the adjustment of the tension of the spring 80, the protuberant part 93*b* of the adjusting nut 93 is once again engaged with the cut window 99 of the rotation prevention member 92, thereby fixing it so that the adjustment nut 93 may not rotate. In addition, the lock nut 94 is screwed into the adjusting screw from above the rotation prevention member 92, thereby maintaining its position.

According to this construction, the adjusting screw 91 is hardly rotated while it is maintained at a position which gives the least resistance to the spring 80. Because of this, any loosening of the adjusting nut 93 and shaking of the adjusting screw 91 are prevented. As it does not affect the tension of the spring 80, moreover, the beater can be returned at a fixed tension at all times.

According to this construction, each beater rotary shaft is rotated for changing the height positions of the first pedal 12 and the second pedal 22, because the installation member 17, 27 also rotates at the same time. As a result, the strap S is either rolled in or rolled back, thereby adjusting the height of the pedals. As the cam 70 is fixed to the beater rotary shaft at a desired position, the height position of the pedal can be changed. In this connection, as each beater rotary shaft 33 and 34 is installed freely rotatably as compared with the cam 70, through the cam receiver 73, it becomes possible for the position of each pedal to be changed without any step in response to the requirements of pedal height.

As is shown in FIG. 6, the beater installation parts 36 and 38 can be rotated without changing the position of the rotation of each beater rotary shaft 33 and 34. It becomes possible to fix the beater at the desired amplitude distance of the drum head, while the height position of each pedal is being maintained.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Dual drum pedals, comprising:

a first shaft support;

a first rotary shaft supported for rotation at the first support;

a first pedal;

first means connecting the first pedal to the first rotary shaft for rotating the first rotary shaft in a first direction upon operation of the pedal;

a first rotary beater supported on the first shaft for being swung from a position away from a drum head to a position to beat the drum head when the first pedal is operated to operate the first rotary shaft to rotate in a first direction;

a second shaft support;

a second rotary shaft supported for rotation at the second support;

a second pedal;

second means connecting the second pedal to the second rotary shaft for rotating the second rotary shaft in a second direction upon operation of the pedal;

a second beater supported on the second rotary shaft for being swung from a position away from a drum head to a position to beat the drum head when the second pedal is operated to operate the second rotary shaft to rotate in the second direction;

the first rotary shaft including a first end with a bearing disposed therein;

the second rotary shaft including a second end received in the bearing of the first shaft for the bearing to link the first and second rotary shafts, while permitting the first and second rotary shafts to rotate independently of each other for moving the respective beaters against the drum head.

2. The dual drum pedals of claim 1, wherein the first rotary shaft has a third end opposite the first end and the second rotary shaft has a fourth end opposite the second end;

the first means comprising a first operating shaft connected with the third end of the first rotary shaft; the first pedal being connected with the first operating shaft for rotating the first operating shaft to rotate the first rotary shaft;

the second means comprising a second operating shaft connected with the fourth end of the second rotary shaft; the second pedal being connected with the second operating shaft for rotating the second operating shaft to rotate the second rotary shaft.

3. The dual drum pedals according to claim 2, wherein the first and second shaft supports are spaced from respective opposite sides of the bearing;

a first cam connected to the first beater rotary shaft; a first tension member connected between the first cam and the first support for drawing on the cam to rotate the first rotary shaft to raise the first beater away from the drum head; and a second cam connected to the second beater rotary shaft; a second tension member connected between the second cam and the second support for drawing on the second cam to rotate the second rotary shaft to raise the second beater away from the drum head.

4. The dual drum pedals according to claim 3, wherein said supports are disposed on opposite sides of said beater assembly.

5. The dual drum pedal according to claim 3, wherein said tension member is a spring.

6. The dual drum pedals according to claim 3, wherein the first cam is mounted adjustably around the first rotary shaft, whereby the first tension member acting on the first cam sets the initial rotative orientation of the first rotary shaft dependent upon the orientation of the first cam around the first rotary shaft and through the first means sets the initial position of the first beater with reference to the drum head;

the second cam is mounted adjustably around the second rotary shaft, whereby the second tension member acting on the second cam sets the initial rotative orientation of the second rotary shaft dependent upon the orientation of the second cam around the second rotary shaft and through the second means sets the initial positions of the second beater with reference to the drum head.

7. The dual drum pedals according to claim 3, wherein the first means comprises a first installation member fixed to the first operating shaft and a first strap connecting the first installation member on the first operating shaft to the first pedal, whereby the first pedal rotates the first operating shaft;

the second means comprise a second installation member fixed to the second operating shaft and a second strap connecting the second installation member on the second operating shaft to the second pedal, whereby the second pedal rotates the second operating shaft.

8. The dual drum pedals of claim 7, wherein each of the first and second beaters comprises a beater element and a shaft supporting the beater element, the shaft of the beater element being adjustably supported on the respective first and second beater installation member wherein the shaft length is adjustable for adjusting the initial position of the beater element with reference to the drum and the beater rotary shaft.

9. The dual drum pedals according to claim 3, further comprising an adjusting device disposed between each of the tension members and its respective support for adjusting the tension of the tension members and for thereby adjusting the respective return speeds of the first and second beaters of the drum.

10. The dual drum pedals of claim 2, further comprising means for mounting the first beater in an initial rotative position around the first shaft, for setting the initial spacing between the first beater and the drum head and for establishing the amount of rotation of the first beater rotary shaft for operation of the first pedal for bringing the first beater into contact with the drum head; and means for mounting the second beater in an initial rotative position around the second shaft, for setting the initial spacing between the second beater and the drum head and for establishing the amount of rotation of the second beater rotary shaft for operation of the second pedal for bringing the second beater into contact with the drum head.

11. The dual drum pedals according to claim 1, wherein the bearing and the first rotary shaft are integral.

* * * * *